United States Patent [19]

Dransfield

[11] 4,087,803

[45] May 2, 1978

[54] FIRE BOX ALARM

[76] Inventor: Vincent Dransfield, 1 Woodside Ave., Little Falls, N.J. 07424

[21] Appl. No.: 785,451

[22] Filed: Apr. 7, 1977

Related U.S. Application Data

[63] Continuation-in-part of Ser. No. 652,767, Jan. 27, 1976.

[51] Int. Cl.[2] ..... G08B 25/00

[52] U.S. Cl. ..... 340/297; 340/299; 340/304

[58] Field of Search ..... 340/297, 299, 304

[56] References Cited

U.S. PATENT DOCUMENTS 3,531,794 9/1970 Goerner ..... 340/297

*Primary Examiner*—Harold I. Pitts

[57] ABSTRACT

A local alarm apparatus mounted on a conventional alarm box to provide an audible and visual alarm that a fire alarm is being sent so that passersby will take notice .of the sender in the event a false alarm is sent. The audible and visual alarm is connected in parallel with the main fire D.C. alarm circuit so that activation of the main circuit will activate the local alarm. The local alarm is coupled to and powered by an A.C. power supply located at a remote location and coupled to the conventional fire alarm transmission lines.

9 Claims, 5 Drawing Figures

Fig. 1.
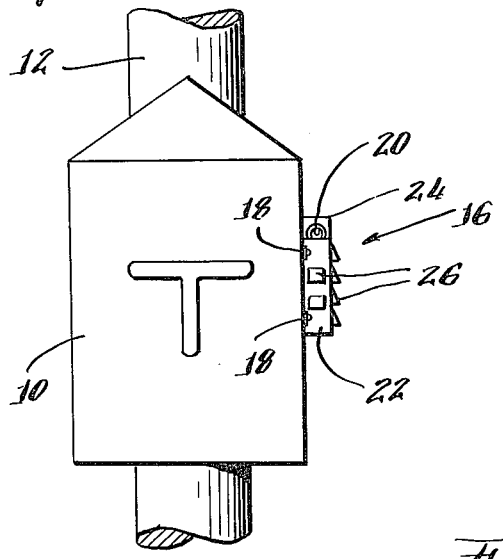
Fig. 2.
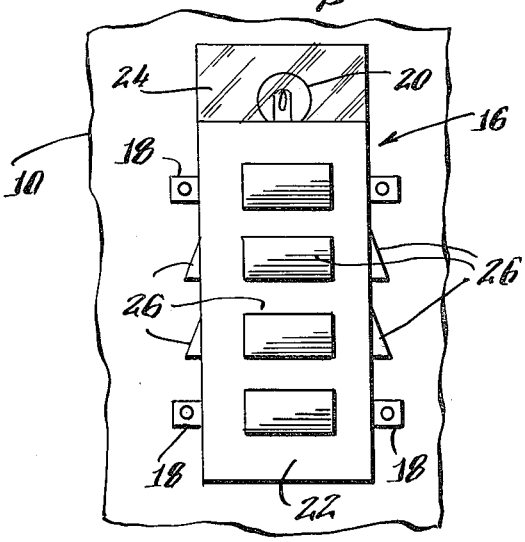
Fig. 3.
PRIOR ART
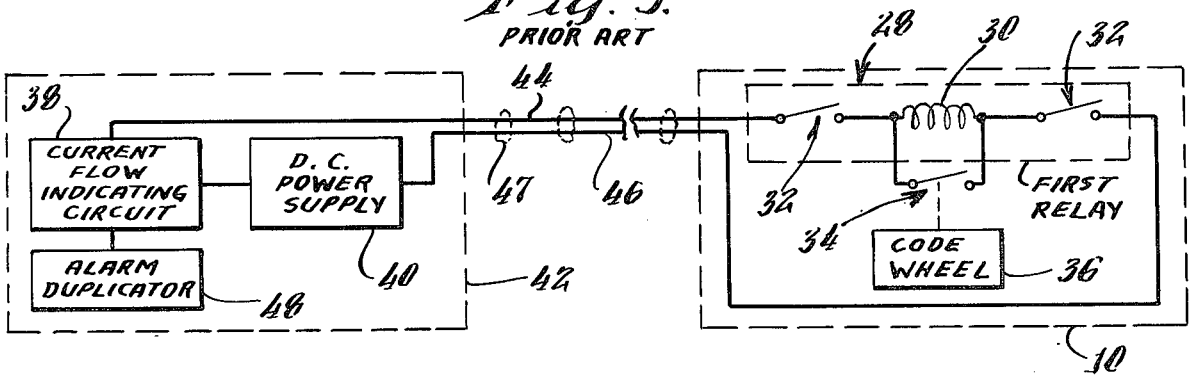
Fig. 4.
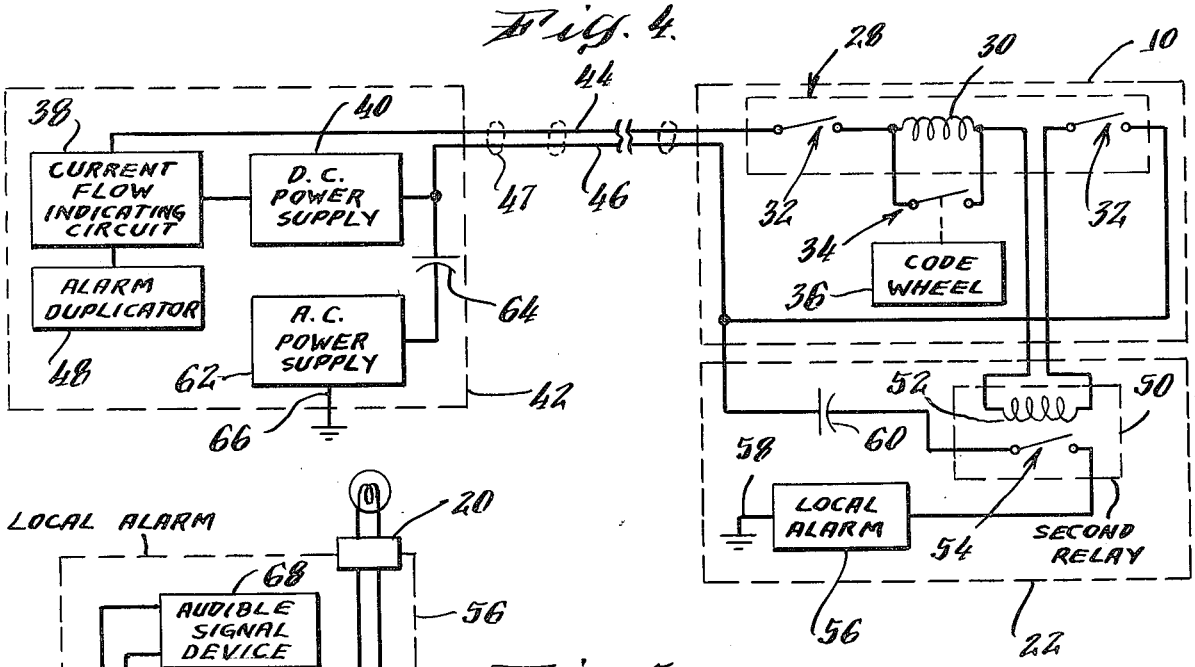
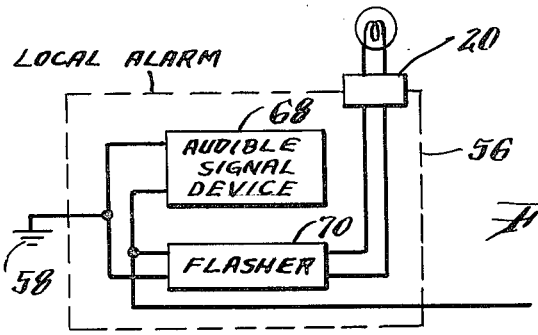
Fig. 5.

FIRE BOX ALARM

BACKGROUND OF THE INVENTION

Field of the Invention

This is a continuation-in-part of Ser. No. 652,767, filed Jan. 27, 1976.

The present invention relates to local alarm apparatuses, and more particularly, to a local alarm apparatus mounted on a fire alarm box for detecting false alarms from being transmitted.

DESCRIPTION OF THE PRIOR ART

In the past, considerable time and expense has been expended by police and fire departments in answering false alarms transmitted by the activation of local alarm boxes by pranksters. Such false alarms have recently increased and have become a serious problem affecting the day to day normal operation of many fire departments.

The advantages of a local alarm apparatus for use in conjunction with a conventional alarm system are well recognized in the art. Typical of such systems are those disclosed in U.S. Pat. Nos. 1,857,040, 2,067,705 and 1,136,607. A serious drawback is that local alarm apparatuses must be powered by some source of power. Proposals have been made for the use of batteries and for the connection of local alarm apparatuses to available power mains. The use of batteries requires great servicing costs, while the couplings of a local alarm apparatus to power mains entails extensive installation at each alarm box which can only be effected at a great cost.

The present invention oversees the problems associated with the prior art by providing a local alarm apparatus which attracts attention to the alarm sender and which is powered through existing fire alarm transmission lines.

SUMMARY OF THE INVENTION

Therefore, a primary object of the present invention is to provide a local alarm apparatus for use with a conventional alarm box.

A further object is to provide a local alarm apparatus which exposes to view by persons nearby, a person that is in the process of sending a firm alarm from an alarm box to a central station, so that if a false alarm is sent, he can be readily identified.

A still further object is to provide a local alarm apparatus which is powered by a remote power source coupled to existing firm alarm transmission lines.

Still another object is to provide a local alarm apparatus which may be quickly and easily installed on existing alarm boxes.

Another object is to provide a local alarm apparatus which is simple in design, inexpensive to manufacture and durable.

In order that the present invention may be more fully understood it will now be described, by way of example, with reference to the accompanying drawing in which:

A local alarm apparatus adapted to be used in conjunction with a conventional fire alarm circuit which includes at least one local alarm box, normally closed switch means disposed at the local alarm box, the switch means being coupled in parallel to the coil of first relay means having a pair of normally closed contacts, the normally closed contacts being in series with the coil, current flow indicating means and a D.C. power supply located remotely in relation to the local alarm box, the current indicating means and the D.C. power supply being coupled in series by a pair of transmission lines to the first relay means contact and the coil thereof to form a closed circuit, the opening of the switch means energizing the relay means to open the contacts thereof thereby opening the closed circuit, the current flow indicating means sensing the cessation of current flow through the closed circuit and activating a suitable remote alarm indicator disposed at the same remote location as the current flow indicating means and the D.C. power supply, the local alarm apparatus according to the principle of the present invention including a box adapted to the mounted on the local alarm box; local alarm means disposed within the box; second relay means disposed within the box and providing a coil being coupled in series to the coil of the first relay means, the coils being in parallel with the switch means, the second relay means providing a pair of normally open relay contacts; first means for coupling the power on one terminal of an A.C. power supply to one of the transmission lines and the power on the other terminal of the A.C. power supply to an electrical earth ground, the A.C. supply being disposed at the remote location; second means for coupling only the A.C. power from the one transmission line to one of the normally open contacts of the second relay means, the other of the pair of normally open contacts of the second relay means being coupled in series to the local alarm means and an electrical earth ground adjacent to the box.

BRIEF DESCRIPTION OF THE DRAWING

In order that the present invention may be more fully understood it will now be described, by way of example, with reference to the accompany drawing in which:

FIG. 1 is a front view in elevation of a conventional fire alarm box mounted on a pole with a local alarm apparatus incorporating the principle of the present invention mounted therein;

FIG. 2 is an enlarged fragmenting side view of a conventional fire alarm box mounted on a pole, with the local alarm apparatus of the present invention mounted therein;

FIG. 3 is an electrical schematic illustrating a conventional fire alarm system;

FIG. 4 is an electrical schematic illustrating the present invention electrically coupled to a conventional fire alarm system; and FIG. 5 is an electrical schematic illustrating the local alarm means of the present invention.

DESCRIPTION OF THE PREFERRED EMBODIMENT

Referring now to the figure, and more particularly, to FIGS. 1 and 2 thereof, there is illustrated therein a conventional fire alarm box 10 mounted on a pole 12. The box 10 provides a pull lever 14 which will activate an alarm in a fire station or other remote location as illustrated in FIG. 3. A local alarm apparatus 16 is mounted to the box 10 by a plurality of mounting brackets 18. A lamp 20 is mounted on a housing 22 provided by the apparatus 16 and is protected by a preferably transparent done 24. A plurality of sound vents and sound directly flanges 26 are disposed in the walls 26 of the housing 22.

FIG. 3 illustrates the circuiting of a conventional fire alarm system. Within the box 10 is a first relay 28, also known in the alarm trade as a non-interfering magnet, which provides a coil 30 and two pair of normally closed contacts 32 viewed in series therewith. A switch 34 is connected in parallel across the coil 30. The switch 34 is mechanically coupled to the pull lever 14, not shown, through a mechanical code wheel apparatus 36. The code wheel 36 is preferably operated by a coil spring and may be set up for an initial activation of the switch 34 followed by a brief deactivation and then reactivation to check to see if any other pull lever at another box has been pulled. Such a use for a code wheel is well known in the art and forms no part of the present invention.

A current flow indicating circuit 38 and a D.C. power supply 40 are connected in series at a location 42 remote to the local alarm box 10. The power supply 40 and the indicating circuit 38 are coupled in series to the first relay 28 by a pair of conventional transmission lines 44 and 46 typically provided in a single cable 47. It is to be understood that any member of first relays 28 disposed in local alarm boxes 10 may be employed. The current flow indicating circuit 38 is well known in the art and monitors the flow of a preferably 100 ma current supplied by the D.C. power supply 40 to the series circuit found by the supply 40, the circuit 38 and the first relay 28. When the switch 34 is opened by the pulling of the pull levers 14, the coil 30 is energized opening the normally closed contacts 32. When the current flow indicating circuit 38 senses the breaking of the series circuit it activates a suitable alarm indicator 48 located at the location 42.

FIG. 4 illustrates the conventional fire alarm circuit of FIG. 3 modified according to the teachings of the present invention. A second relay 50 having a coil 52 and a pair of normally open contacts 54 is installed within the housing 22. The coil 52 is wired in series with the coil 30 of the first relay 28, with the coils 30 and 52 being in parallel with the switch 34. The relay 50 is of the self latching type and includes resetting circuits well known in the art. When the switch 34 is opened, the coil 52 is energized in the same manner as the coil 30 as hereinbefore described. The second relay 50 latches closing the normally open contacts 54. One of the contacts 54 is connected in series to a local alarm 56 disposed within the housing 22, the local alarm 56 being connected in series to a suitable electrical earth ground 58 such as a ground rod or the lites. The other contact 54 of the second relay is coupled through a capacitor 60 to the end of the transmission line 46 which enters the box 10. An A.C. power supply 62 is coupled to the end of the transmission line 46 at the remote location 42 through a capacitor 64 and to a suitable electrical earth ground 66 at location 42. The A.C. power supply 62 couples power to the transmission line 46 through the capacitor 64 with the power being coupled to the contact 54 through the capacitor 60. The earth serves as a return line between the ground connections 58 and 66. Since the capacitors 60 and 64 pass A.C. and block D.C. the added circuitry of the present invention does not interfere with the conventional fire alarm system as long as the frequency of the A.C. is great enough to prevent relay clatter in the first and second relays 28 and 50. It is suggested that the frequency of the A.C. supply be in the audio range to avoid this problem. The second relay 50 may alternatively be of the time delay type which will activate the local alarm 56 for an interval preselected by the user.

FIG. 5 illustrates the preferred circuitry of the local alarm 56. The local alarm 56 include an audible signal device 68 such as a horn, bell, siren, or the like connected in parallel to a flasher 70 connected to the lamp 20 illustrated in FIGS. 1 and 2. The lamp 20, flasher 70 and the audible signal device 68 are all adapted to be powered by the A.C. power supply 62.

In operation, when the pull lever 14 is pulled the relays 28 and 50 are activated. The relay 28 breaks the series circuit found by the relay 28, the D.C. power supply 40 and the current indicating circuit 38. The current indicating circuit 38 then activates the alarm indicator 48 located at the location 42. Simultaneously, the relay 50 completes a series circuit including the local alarm 56 and the A.C. power supply 62. The alarm indicator 48 sounds the audible signal device 68 and the lamp 20 illuminating the person who pulled the lever 14 drawing attention to him.

Accordingly, it is an advantage of this invention to provide an apparatus for sounding a secondary alarm at the fire box in order to attract attention to the alarm sender as a deterrent to sending false alarms.

A further advantage of this invention is to provide an apparatus of the character indicated for exposing to view by persons nearby, a person that is in the process of sending the fire alarm to a central station, so that if a false alarm is sent, he can be readily identified.

Having thus set forth the nature of the invention, what is claimed is:

1. A local alarm apparatus adapted to be used in conjunction with a conventional fire alarm circuit which includes at least one local alarm box normally closed switch means disposed at said local alarm box, said switch means being coupled in parallel to the coil of first relay means having a pair of normally closed contacts, said normally closed contacts being in series with said coil, current flow indicating means and a D.C. power supply located remotely in relation to said local alarm box, said current indicating means and said D.C. power supply being coupled in series by a pair of transmission lines to said first relay means contact and said coil to form a closed circuit, the opening of said switch means energizing said relay means to open the contacts thereof thereby opening said closed circuit, said current flow indicating means sensing the cessation of current flow through said closed circuit and activating a suitable remote alarm indicator disposed at the same remote location as said current flow indicating means and said D.C. power supply, said local alarm apparatus comprising:

a box adapted to be mounted on said local alarm box;

local alarm means disposed within said box;

second relay means disposed within said box and providing a coil being coupled in series to said coil of said first relay means, said coils being in parallel with said switch means, said second relay means providing a pair of normally open relay contacts;

first means for coupling the power on one terminal of an A.C. power supply to one of said transmission lines and the power on the other terminal of said A.C. power supply to an electrical earth ground, said A.C. power supply being disposed at said remote location;

second means for coupling only said A.C. power from said one transmission line to one of said normally open contacts of said second relay means, the other of said pair of normally open contacts of said second relay means being coupled in series to said local alarm means and an electrical earth ground adjacent to said box.

2. A local alarm apparatus in accordance with claim 1, wherein said local alarm means includes an audible alarm.

3. A local alarm apparatus in accordance with claim 2, wherein said local alarm means includes a light in electrical parallel with said audible alarm.

4. A local alarm apparatus in accordance with claim 2, further comprising a plurality of sound vents in the exterior surface of said box.

5. A local alarm apparatus in accordance with claim 1, further comprising a plurality of mounting bracket secured to said box.

6. A local alarm apparatus in accordance with claim 1, wherein said first coupling means comprises a capacitor.

7. A local alarm apparatus in accordance with claim 1, wherein said second relay means is of the self-latching type.

8. A local alarm apparatus in accordance with claim 1, wherein said second relay means includes a time delay to maintain said second coil thereof in an energized position for a pre-selected interval of time.

9. A local alarm apparatus in accordance with claim 1 wherein the frequency of said A.C. power supply is in the audio range.

* * * * *